US006734618B2

(12) United States Patent
Ku et al.

(10) Patent No.: US 6,734,618 B2
(45) Date of Patent: May 11, 2004

(54) VACUUM FLUORESCENT DISPLAY WITH RIB GRID

(75) Inventors: Ja-Wook Ku, Ulsan (KR); Chang-Hyun Pyo, Ulsan (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 10/188,220

(22) Filed: Jul. 2, 2002

(65) Prior Publication Data

US 2003/0042841 A1 Mar. 6, 2003

(30) Foreign Application Priority Data

Aug. 29, 2001 (KR) ..... 2001-52600

(51) Int. Cl.[7] ..... H01J 1/62

(52) U.S. Cl. ..... 313/495; 313/496; 313/497; 313/522

(58) Field of Search ..... 313/495, 496, 313/497, 522, 513

(56) References Cited

U.S. PATENT DOCUMENTS 4,542,317 A * 9/1985 Morimoto et al. ..... 313/496
4,825,230 A * 4/1989 Shimizu ..... 313/497
5,179,317 A * 1/1993 Watanabe et al. ..... 313/496

FOREIGN PATENT DOCUMENTS

JP 6-251732 9/1994
JP 8-138591 5/1996

* cited by examiner

*Primary Examiner*—Nimeshkumar D. Patel
*Assistant Examiner*—Sharlene Leurig
(74) *Attorney, Agent, or Firm*—Christie, Parker & Hale, LLP

(57) ABSTRACT

A vacuum fluorescent display includes a vacuum tube with a pair of substrates, and a side glass disposed between the two substrates. Filaments are mounted within the vacuum tube to emit thermal electrons. A conductive layer is formed at one of the substrates with a predetermined pattern, and a phosphor layer is formed on the conductive layer. A rib grid is provided at the substrate with an insulating rib positioned around the conductive layer, and a control electrode is formed on the top surface of the insulating rib. Assuming that the distance between the top surface of the substrate and the top surface of the insulating rib is indicated by h1, and the distance between the top surface of the substrate and the top surface of the phosphor layer is indicated by h2, it is established that h1≦h2.

18 Claims, 4 Drawing Sheets

VACUUM FLUORESCENT DISPLAY WITH RIB GRID

CROSS-REFERENCE TO RELATED APPLICATIONS

This application claims priority of Korean Application No. 2001-52600, filed on Aug. 29, 2001 in the Korean Patent Office, the entire content of which is incorporated herein by reference.

FIELD OF THE INVENTION

The present invention relates to a vacuum fluorescent display, and more particularly, to a vacuum fluorescent display which has a rib grid.

BACKGROUND OF THE INVENTION

Generally, a vacuum fluorescent display (VFD) is a light-emitting display device wherein thermal electrons emitted from cathode filaments selectively land on a phosphor layer by way of a control electrode and an anode electrode to thereby produce light. Since a VFD has excellent visibility, a wide viewing angle, a low driving voltage, and high reliability, it is well adapted for use as a display device in various fields.

In a VFD, a metallic mesh-type grid (referred to hereinafter simply as the "mesh grid") is used as the control electrode.

The mesh grid is formed with a mesh that is produced through etching a thin metal plate of stainless steel (SUS). The mesh grid is mounted on a substrate with a phosphor layer while being supported by a support at its periphery such that it is spaced apart from the substrate at a predetermined distance.

In order to make the thermal electrons land on the intended point of the phosphor layer and prevent the electrons from hitting unintended points on the phosphor layer, there should be a predetermined distance between the support and the anode electrode as well as between the mesh grid and the substrate. However, in such a case, it becomes difficult to pattern the VFD with a mesh grid such that it is provided with a minute pattern or a complex polygonal pattern.

Furthermore, the mesh grid is liable to sink at its center due to thermal deformation in use or during the fabrication process. In this case, the capacity of the mesh grid for accelerating and diffusing the thermal electrons becomes deteriorated in such a way that a brightness difference between the neighboring phosphor occures.

In order to prevent the mesh grid from sinking at its center, the mesh grid may be mounted on the substrate while being supported by a plurality of supports. However, as the number of the supports is increased, the pattern design for the anode electrode becomes more limited.

In order to solve such a problem, Japanese Patent Publication No. Hei 6-251732 discloses a grid for a VFD, with the following features, as shown in FIG. 5. A carbon layer 112 and a phosphor layer 114 are formed at the substrate in a predetermined pattern, and an insulating rib 116 is mounted around the carbon layer 112 and the phosphor layer 114. A conductive material layer 118 is formed at the top surface of the rib 116 while bearing the same pattern as the rib 116.

The insulating rib 116 rises above the phosphor layer 114 by 20$\mu$m or more to prevent a short circuit between the conductive material layer 118 and the phosphor layer 114. That is, the insulating rib 116 and the conductive material layer 118 are disposed around the phosphor layer 114 while being used as a grid.

As the insulating rib 116 rises above the phosphor layer 114, when the thermal electrons reach the phosphor layer 114, some of the thermal electrons are liable to be accumulated at the surface of the insulating layer 119 around the insulating rib 116, and remain charged.

In this case, the electric fields distributed at the phosphor layer 114 are non-uniformly formed under the influence of the charged electrons so that light emission spots occur at the phosphor layer 114.

In order to solve such a problem, Japanese Patent Publication No. Hei 8-138591 discloses a VFD with the features as shown in FIG. 6. A conductive layer 122 and a phosphor layer 124 are formed at the substrate 120, and an insulating rib 126 is formed on the conductive layer 122 around the phosphor layer 124 while rising above the phosphor layer 124. A grid electrode 128 is formed at the top surface of the insulating rib 126, and a subsidiary insulating rib 126' and a subsidiary grid electrode 128' are formed on the insulating layer 129 around the conductive layer 122 while bearing the same pattern as the insulating rib 126 and the grid electrode 128.

The conductive layer 122 prohibits accumulation of electrons at the surface of the insulating layer 129, thereby preventing occurrence of light emission spots at the phosphor layer 124.

However, the above technique results in the following problem. In order to form the insulating rib, an insulating paste is printed at a predetermined thickness (for instance, 10–30 $\mu$m), and dried. This process is repeated three to fifteen times. Furthermore, the formation of the grid electrode on the insulating rib should be done in the same manner. Therefore, much time is consumed for the repeated printings, and the production efficiency deteriorates.

When the grid electrode is formed through printing a conductive material, gas generated from the conductive material may remain within the vacuum tube. In this case, the flowing of the thermal electrons to the phosphor layer is obstructed by the remaining gas, and the gas is attached to the filaments or the phosphor layer and prohibits the fluent operation of the display device. Therefore, the brightness or the life span of the display device deteriorates.

In the case the occurrence of light emission spots at the phosphor layer is prevented by way of the subsidiary insulating rib and the subsidiary grid electrode, the pattern design for the VFD is limited due to the additional components.

SUMMARY OF THE INVENTION

In one embodiment, the present invention provides a vacuum fluorescent display VDF that secures a pattern formation space in an easy manner while preventing occurrence of light emission spots at the phosphor layer.

In one embodiment, the present invention provides a VDF that prevents deterioration in the brightness and the life span of the VDF due to the impurities occurring during the processing in one embodiment.

In one embodiment, the VDF includes a vacuum tube with a pair of substrates, and a side glass disposed between the two substrates. Filaments are mounted within the vacuum tube to emit thermal electrons. A conductive layer is formed at one of the substrates with a predetermined pattern, and a phosphor layer is formed on the conductive layer. A rib grid is provided at the substrate with an insulating rib positioned around the conductive layer, and a control electrode is formed on the top surface of the insulating rib. Assuming that the distance between the top surface of the substrate and the top surface of the insulating rib is indicated by h1 and the distance between the top surface of the substrate and the top surface of the phosphor layer is indicated by h2, it is established that h1≦h2.

In one embodiment, the control electrode is formed with a metallic material while bearing a single-layered structure. The metallic material for the control electrode is selected from stainless steel, platinum, silver, or copper.

The insulating rib rises above the conductive layer, and the control electrode rises above the phosphor layer.

An extension may be extended from the top end of the control electrode toward the center of the phosphor layer, in one embodiment.

In one aspect, the invention describes a vacuum fluorescent display comprising: a vacuum tube with a pair of substrates, and a side glass disposed between the two substrates; filaments mounted within the vacuum tube to emit thermal electrons; a conductive layer formed at one of the substrates with a predetermined pattern; a phosphor layer formed on the conductive layer; and a rib grid having an insulating rib positioned around the conductive layer, and a control electrode formed on the top surface of the insulating rib; wherein when the distance between the top surface of one of the substrates and the top surface of the insulating rib is indicated by h1 and the distance between the top surface of the substrate and the top surface of the phosphor layer is indicated by h2, it is established that h1≦h2.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION

Figure 1:
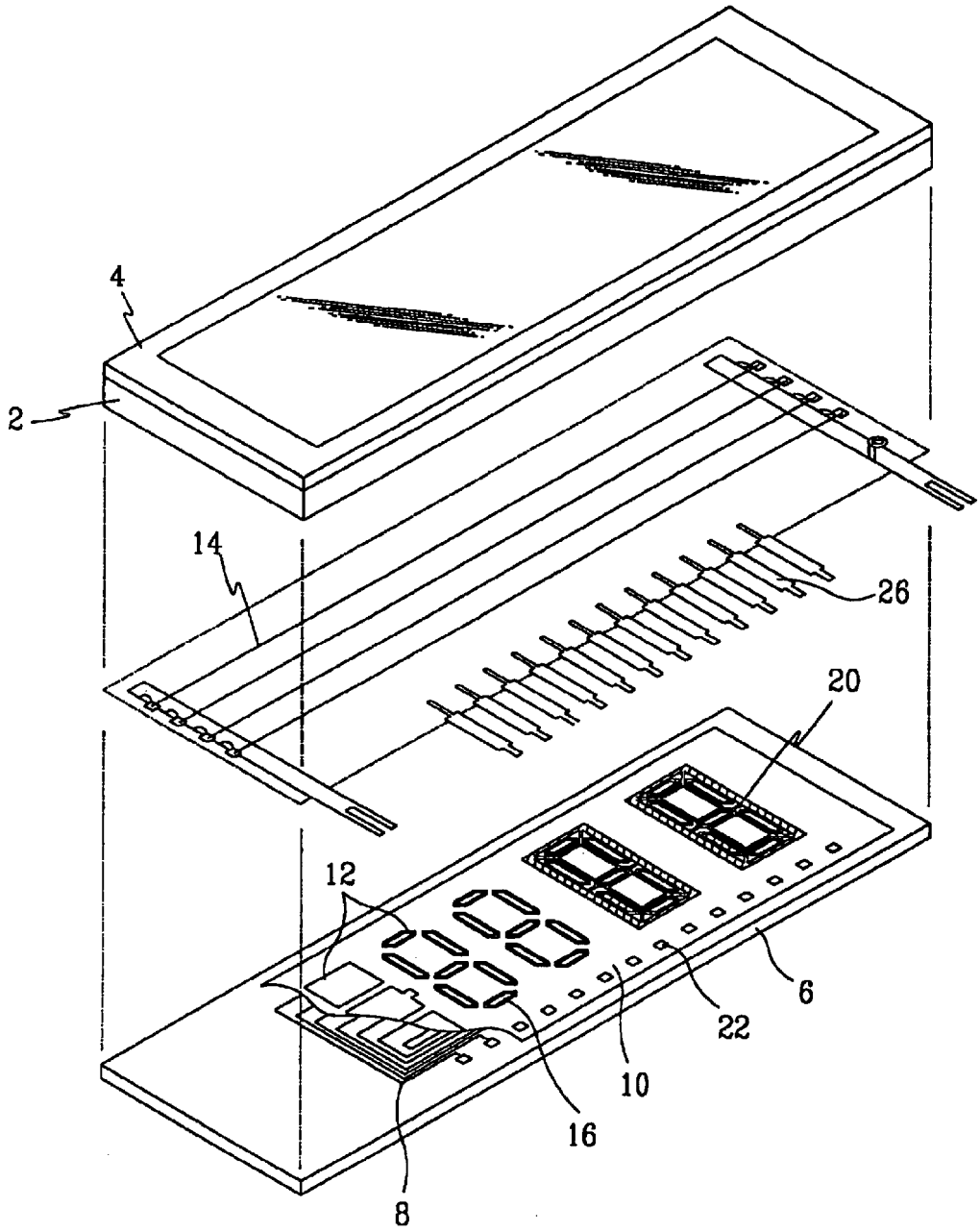
FIG. 1 is an exploded perspective view of a vacuum fluorescent display according to an embodiment of the present invention.
Figure 2:
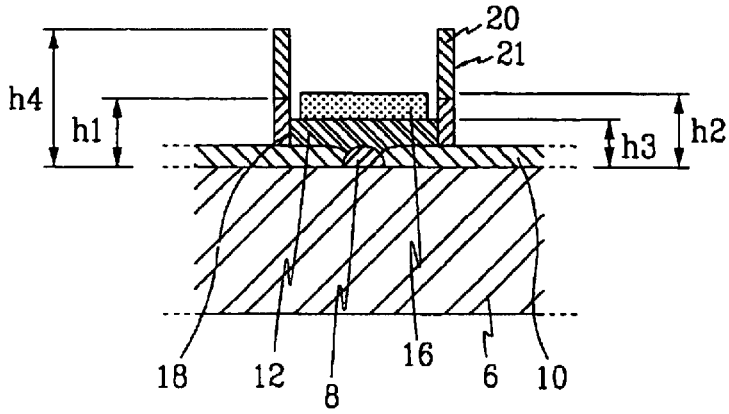
FIG. 2 is a cross sectional view of the vacuum fluorescent display shown in FIG. 1, according to one embodiment of the present invention.

FIG. 1 is an exploded perspective view of a vacuum fluorescent display according to one embodiment of the present invention, and FIG. 2 is a cross sectional view of the vacuum fluorescent display shown in FIG. 1.

As shown, the vacuum fluorescent display is schematically outlined with a vacuum tube having a pair of front and back substrates 4 and 6, and a side glass 2 disposed between the substrates 4 and 6.

Wiring lines 8 are patterned on the back substrate 6 to apply electrical signals to the inside of the vacuum tube, and an insulating layer 10 is formed on the back substrate 6 to prohibit unnecessary electrical communication between the wiring lines 8. A conductive layer 12 is formed on the wiring lines 8 while electrically communicating with the wiring lines 8. A phosphor layer 16 is formed on the conductive layer 12 such that it is excited by way of the thermal electrons emitted from cathode filaments 14 to thereby produce light.

A rib grid 21 surrounds each segment of the phosphor layer 16 while being placed around the conductive layer 12 to control the thermal electrons emitted from the filaments 14, as shown in FIG. 2.

The formation of the rib grid 21 is made in the following way. The rib grid 21 includes an insulating rib 18 formed on the insulating layer 10 around the conductive layer 12, and a control electrode 20 formed on the top surface of the insulating rib 18.

The insulating rib 18 prevents the control electrode 20, the conductive layer 12, and the phosphor layer 16 from electrically communicating with each other. Assuming that the distance between the top surface of the substrate 6 and the top surface of the insulating rib 18 is indicated by h1 and the distance between the top surface of the substrate 6 and the top surface of the phosphor layer 16 by h2, it is established that h1≦h2.

Also, assuming that the distance between the top surface of the substrate 6 and the top surface of the conductive layer 12 is indicated by h3, it is established that h3≦h1.

In one embodiment, the top surface of the insulating rib 18, as show in FIG. 2, is positioned between the top and bottom surfaces of the phosphor layer 16 according to the above conditions. Specifically, it is preferable that the interrelationship between h1 and h3 satisfies the following condition: 10 $\mu$m≦h1−h3≦20 $\mu$m.

Of course, the insulating rib 18 is not limited to the above, but may be designed in various manners depending upon the thickness of the phosphor layer 16.

The control electrode 20 accelerates or intercepts the thermal electrons emitted from the filaments 14 while controlling light emission of the phosphor layer 16. That is, the control electrode 20 substantially takes the role of a grid. The control electrode 20 is formed with a metallic material bearing high electrical conductivity, preferably with stainless steel. The control electrode 20 may be formed with other metallic materials bearing an electrical conductivity higher than the stainless steel, for instance with platinum, silver, or copper.

Lead pads 22 are formed at the control electrode 20 such that they are connected to the wiring lines 8. The lead pads 22 receive voltages from the outside and apply them to the control electrode 20 via the wiring lines 8. Alternatively, separate lead pins 26 may be formed at the control electrode 20 such that they are connected to the lead pads 22. In this case, the voltages are applied to the control electrode 20 via the lead pins 26 without passing the wiring lines 8.

The control electrode 20 rises above the phosphor layer 16 to make the desired electronic control in an easy manner. That is, assuming that the distance between the top surface of the substrate 6 and the top surface of the control electrode 20 is indicated by h4, it is established that h4>h2.

Furthermore, in this embodiment, it is preferable that the relationship between h4 and h2 satisfies the following condition: 150 $\mu$m≦h4−h2≦180 $\mu$m.

Of course, the relative height of the control electrode 20 with respect to the phosphor layer 16 may be controlled in various ways depending upon the characteristics of the relevant display device.

In the above embodiment, vacuum fluorescent display, the thermal electrons are controlled by way of the rib grid 21 positioned around the conductive layer 12 and the phosphor layer 16. As the insulating rib 18 of the rib grid 21 is placed below the phosphor layer 16, occurrence of light emission spots at the phosphor layer 16 can be prevented.

When the thermal electrons emitted from the filaments 14 are directed toward the phosphor layer 16 while being controlled by the rib grid 21, they collide with the insulating rib 18. Therefore, the thermal electrons are not flown into the insulating rib 18 while being prohibited from being accumulated at the insulating rib 18 as wall as at the insulating layer 10.

The control electrode 20 may be formed in the following way. In consideration of the overall pattern of the phosphor layer 16 formed at the substrate 6, a metallic layer with a suitable width and thickness is deposited, and etched through photolithography to thereby form a control electrode 20 having a pattern corresponding to the pattern of the phosphor layer 26.

The control electrode 20 is positioned at the top surface of the insulating rib 18 that is previously formed on the substrate 6, and connected to the lead pads or the lead pins such that it can receive the required driving voltages from the outside.

The control electrode 20 may be formed with various patterns. The portion of the control electrode 20 for communicating with the wiring lines 8 and the portion thereof surrounding the conductive layer 12 and the phosphor layer 16 may be also varied in shape depending upon the characteristic of the relevant display device.

Figure 3:
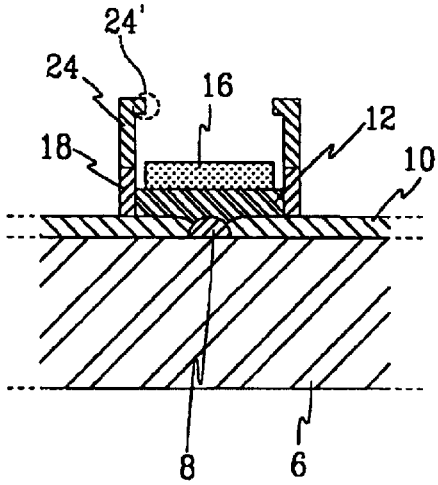
FIG. 3 is a cross sectional view of a control electrode for a vacuum fluorescent display according to another embodiment of the present invention.

FIG. 3 is a cross sectional view of a control electrode for a VFD according to another embodiment of the present invention.

In the case the area of the conductive electrode 24 or the area of the phosphor layer 16 is enlarged, the control power of the control electrode 24 with respect to the thermal electrons to be applied to the phosphor layer 15 is liable to be reduced while deteriorating the cut-off characteristic of the phosphor layer 16. In order to solve such a problem, an extension 24' is extended from the top end of the control electrode 24 in a direction toward the center of the phosphor layer 16 vertical to the control electrode 24.

In this way, even though the area of the phosphor layer 16 is enlarged, the control electrode 24 can form the desired electric fields toward the center of the phosphor layer 16 by way of the extension 24' while conducting its electronic control function in a stable manner.

The extension 24' is preferably extended from the top end of the control electrode 24 such that it is not overlapped with the phosphor layer 16.

Figure 4:
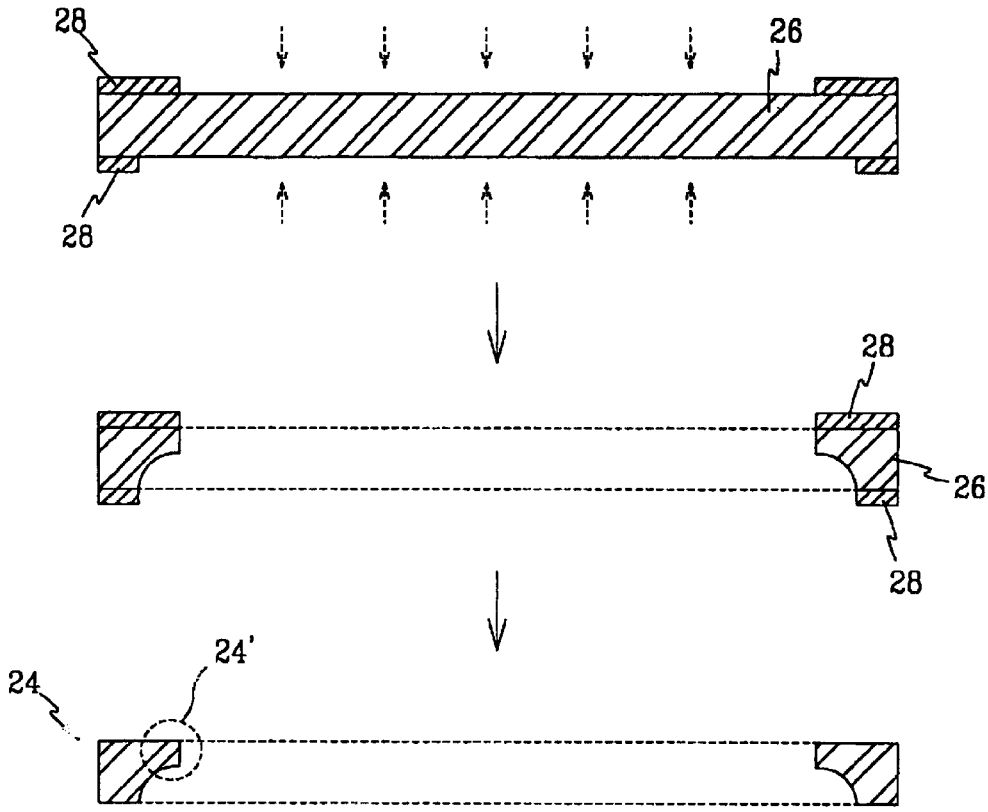
FIG. 4 is a schematic view illustrating a process of forming the control electrode shown in FIG. 3.
Figure 5:
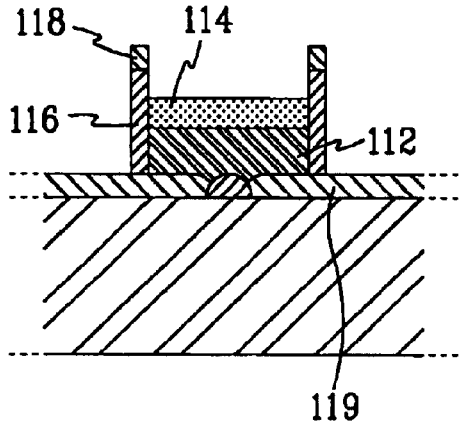
FIG. 5 (Prior Art)
FIG. 5 is a cross sectional view of a vacuum fluorescent display according to a prior art.
Figure 6:
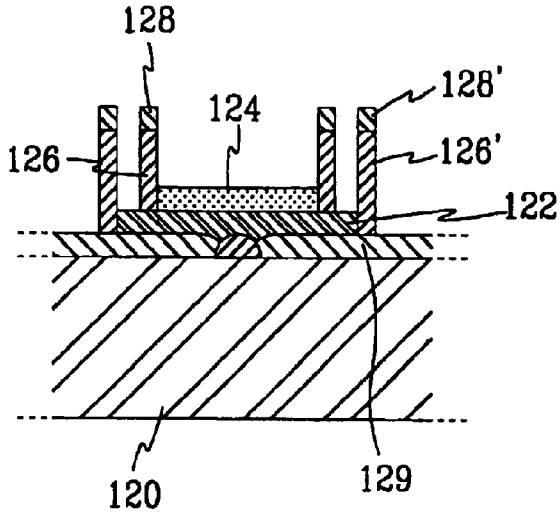
FIG. 6 (Prior Art)
FIG. 6 is a cross sectional view of a vacuum fluorescent display according to another prior art.

As shown in FIG. 4, the control electrode 24 with the extension 24' is formed through coating a photoresist film 28 onto top and bottom surfaces of a metallic layer 26, patterning the photoresist films 28, and double-etching the photoresist films 28 using an etching solution.

As described above, in the inventive VFD, an insulating rib is positioned below the phosphor layer, and a metallic material-based control electrode is mounted to the top surface of the insulating rib so that occurrence of light emission spots at the phosphor layer due to the charged electric potential at the insulating rib and the insulating layer can be prevented. Furthermore, a separate subsidiary grid electrode for prohibiting occurrence of the light emission spots is not needed, and hence the space for the phosphor pattern formation can be secured in an easy manner.

In addition, as the control electrode is formed using a metallic material, the printing process based on a conductive paste can be ruled out. Therefore, the shortcomings accruing to the use of the printing process such as deterioration in the brightness and the life span of the display device due to the gas generated from the conductive material and increase in the number of processing steps can be overcome.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A vacuum fluorescent display comprising:

a vacuum tube with a pair of substrates, and a side glass disposed between the two substrates;

filaments mounted within the vacuum tube to emit thermal electrons;

an insulating layer formed on one of the substrates;

a conductive layer formed on the insulating layer with a predetermined pattern;

a phosphor layer formed on the conductive layer; and a rib grid formed on the insulating layer having an insulating rib formed on the insulating layer and positioned around the conductive layer and a control electrode formed on the top surface of the insulating rib, wherein when the distance between the top surface of the substrate on which the phosphor layer is formed and the top surface of the insulating rib is indicated by h1 and the distance between the top surface of the substrate on which the phosphor layer is formed and the top surface of the phosphor layer is indicated by h2, it is established that $h1 \leqq h2$.

2. The vacuum fluorescent display of claim 1 wherein the control electrode is formed with a metallic material comprising a single-layered structure.

3. The vacuum fluorescent display of claim 2 wherein the control electrode is formed with a metallic material selected from the group consisting of stainless steel, platinum, silver, and copper.

4. The vacuum fluorescent display of claim 1 wherein when the distance between the top surface of one of the substrates and the top surface of the conductive layer is indicated by h3, it is established that $h3<h1$.

5. The vacuum fluorescent display of claim 1 wherein when the distance between the top surface of one of the substrates and the top surface of the control electrode is indicated by h4, it is established that $h4>h2$.

6. The vacuum fluorescent display of claim 5 wherein the inter-relationship between h4 and h2 satisfies the following condition: $150\ \mu m \leqq h4-h2 \leqq 180\ \mu m$.

7. The vacuum fluorescent display of claim 1 wherein the rib grid is positioned on one of the substrates with a predetermined distance from the phosphor layer.

8. The vacuum fluorescent display of claim 1 further comprising an extension extending from the top end of the control electrode toward the center of the phosphor layer.

9. The vacuum fluorescent display of claim 8 wherein the extension is extended from the control electrode such that it is not overlapped with the phosphor layer.

10. A vacuum fluorescent display comprising:

a vacuum tube including a substrate having a top surface;

filaments mounted within the vacuum tube to emit thermal electrons;

an insulating layer formed on the top surface of the substrate;

a conductive layer formed on the insulating layer with a predetermined pattern having a top surface;

a phosphor layer formed on the conductive layer having a top surface; and a rib grid formed on the insulating layer having an insulating rib formed on the insulating layer including a top surface and positioned around the conductive layer and a control electrode formed on the top surface of the insulating rib, wherein the condition of $h1 \leqq h2$ is satisfied, where h1 is the distance between the top surface of the substrate and the top surface of the insulating rib, and h2 is the distance between the top surface of the substrate and the top surface of the phosphor layer.

11. The vacuum fluorescent display of claim 10 wherein the control electrode is formed with a metallic material comprising a single-layered structure.

12. The vacuum fluorescent display of claim 11 wherein the control electrode is formed with a metallic material selected from any one of the group consisting of stainless steel, platinum, silver, and copper.

13. The vacuum fluorescent display of claim 10 wherein when the distance between the top surface of the substrates and the top surface of the conductive layer is indicated by h3, and $h3 < h1$.

14. The vacuum fluorescent display of claim 10 wherein the distance between the top surface of the substrate and the top surface of the control electrode is indicated by h4, and $h4 > h2$.

15. The vacuum fluorescent display of claim 1 wherein the control electrodes do not overlap the phosphor layer.

16. The vacuum fluorescent display of claim 10 wherein the control electrodes do not overlap the phosphor layer.

17. A vacuum fluorescent display comprising:

a vacuum tube with a pair of substrates, and a side glass disposed between the two substrates;

a plurality of filaments mounted within the vacuum tube for emitting thermal electrons;

a conductive layer formed at one of the substrates with a predetermined pattern;

a phosphor layer formed on the conductive layer; and a first rib grid and a second rib grid positioned around the conductive layer, the first rib grid including a first insulating rib portion and a first control electrode portion formed on the top surface of the first insulating rib portion and the second rib grid including a second insulating rib portion and a second control electrode portion formed on the top surface of the second insulating rib portion, wherein the control electrodes are spaced apart from each other and wherein the distance between the top surface of one of the substrates and the top surface of the insulating rib portion is indicated by h1 and the distance between the top surface of the substrate on which the phosphor layer is formed and the top surface of the phosphor layer is indicated by h2, and $h1 \leqq h2$.

18. The vacuum fluorescent display of claim 17 wherein the control electrodes do not overlap the phosphor layer.

* * * * *

UNITED STATES PATENT AND TRADEMARK OFFICE

CERTIFICATE OF CORRECTION

PATENT NO. : 6,734,618 B2
DATED : May 11, 2004
INVENTOR(S) : Ja-Wook Ku et al.

It is certified that error appears in the above-identified patent and that said Letters Patent is hereby corrected as shown below:

Title page,
Item [57], ABSTRACT, delete "h1≦h2", insert -- h1≤h2 --

Column 6,
Line 20, delete "h1≦h2", insert -- h1≤h2 --
Line 3, delete "150μm≦h4-h2≦ 180μm", insert -- 150μm≤h4-h2≤ 180μm --

Column 7,
Line 15, delete "h1≦h2", insert -- h1≤h2 --

Column 8,
Line 18, delete "one of the substrates", insert -- the substrate on which the phosphor layer is formed --
Line 23, delete "h1≦h2", insert -- h1≤h2 --

Signed and Sealed this

First Day of February, 2005

JON W. DUDAS
*Director of the United States Patent and Trademark Office*